United States Patent [19]

Cherbuy et al.

[11] Patent Number: 4,877,341

[45] Date of Patent: Oct. 31, 1989

[54] DEVICE FOR INTERMITTENT APPLICATION OF PARTICLES OF A POWDERED DEVELOPER TO THE RECORDING SURFACE OF A MAGNETOGRAPHIC PRINTER

[75] Inventors: Bernard Cherbuy, Belfont; Jacques Estavoyer, Bavilliers, both of France

[73] Assignee: Bull S.A., Paris, France

[21] Appl. No.: 302,331

[22] Filed: Jan. 27, 1989

[30] Foreign Application Priority Data

Jan. 29, 1988 [FR] France ..... 88 01077

[51] Int. Cl.[4] ..... B41J 3/02

[52] U.S. Cl. ..... 400/119; 101/425; 101/DIG. 37; 346/74.2; 355/215; 355/251; 118/652; 430/125; 430/39

[58] Field of Search ..... 400/119; 101/425, DIG. 37; 346/74.2, 74.3, 74.5; 355/3 CH, 14 D, 3 R, 14 R, 3 FU, 15; 118/651, 652, 653; 15/1.5 R; 430/120, 122, 124–126, 39, 106.6; 427/47–48

[56] References Cited

U.S. PATENT DOCUMENTS

| | | | |
|---|---|---|---|
| 3,161,544 | 12/1964 | Berry | 101/DIG. 37 |
| 3,963,340 | 6/1976 | Gerace | 400/119 |
| 3,990,393 | 11/1976 | Silverberg | 118/657 |
| 4,072,957 | 2/1978 | Kokaji et al. | 346/74.2 |
| 4,117,498 | 9/1978 | Edwards | 427/48 |
| 4,255,041 | 3/1981 | Koumura et al. | 101/DIG. 37 |
| 4,269,503 | 5/1981 | Nishikawa | 355/15 |
| 4,336,546 | 6/1982 | Edwards et al. | 118/652 |
| 4,359,516 | 11/1982 | Nacci et al. | 430/39 |
| 4,372,668 | 2/1983 | Malachowski | 355/14 R |
| 4,426,588 | 1/1984 | Weilenmann . | |
| 4,433,042 | 2/1984 | Kawanishi | 430/126 |
| 4,449,132 | 5/1984 | Magnenet | 430/39 |
| 4,537,494 | 8/1985 | Lubinsky et al. | 118/651 |
| 4,543,586 | 9/1985 | Parker | 346/74.2 |
| 4,618,243 | 10/1986 | Knapp | 430/122 |
| 4,731,633 | 3/1988 | Foley et al. | 355/3 CH |
| 4,737,432 | 4/1988 | Tanaka et al. | 430/110 |
| 4,741,942 | 5/1988 | Swift | 15/1.5 R |
| 4,743,937 | 5/1988 | Martin | 118/653 |
| 4,750,018 | 6/1988 | Gooray et al. | 355/14 R |
| 4,771,311 | 9/1988 | Bray | 355/15 |
| 4,791,447 | 12/1988 | Jacobs | 355/3 FU |

OTHER PUBLICATIONS

Computer Design, vol. 23, No. 11, Oct. 1, 1984, pp. 44–47, Littleton (Mass.), T. Williams: "Low Cost Magnetic Printing Technology Uses Thin-Films Heads".

Patent Abstracts of Japan, vol. 7, No. 85 (M206) (1230), Apr. 9, 1983 & UP-A 58 11 179 (Fuji Xerox K.K.).

*Primary Examiner*—E. H. Eickholt

*Attorney, Agent, or Firm*—Kerkam, Stowell, Kondracki & Clarke

[57] ABSTRACT

The invention relates to a device for intermittently applying particles of a powdered developer to the recording surface of a magnetographic printer. This device includes a reservoir (17) containing developer particles, a transport element (23) for placing these particles in the vicinity of the surface of a magnetic drum (11), a deflector (24) disposed between this transport element and the drum to apply the particles to the drum surface, and a squeegee (45) disposed between the deflector and the transfer station (H), and actuated by an electromagnet (EA) for selectively pulling away the particles that have been deposited on the drum surface. The invention is applicable to magnetographic printers.

27 Claims, 3 Drawing Sheets

FIG.1
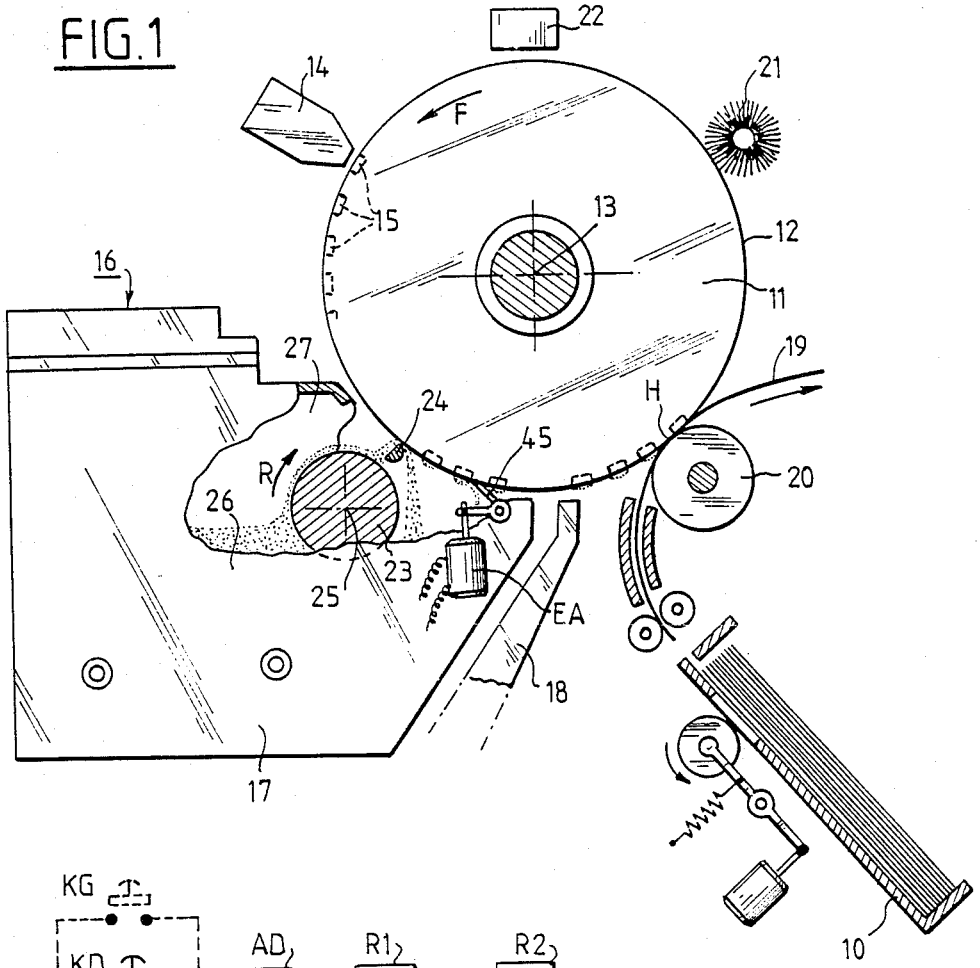
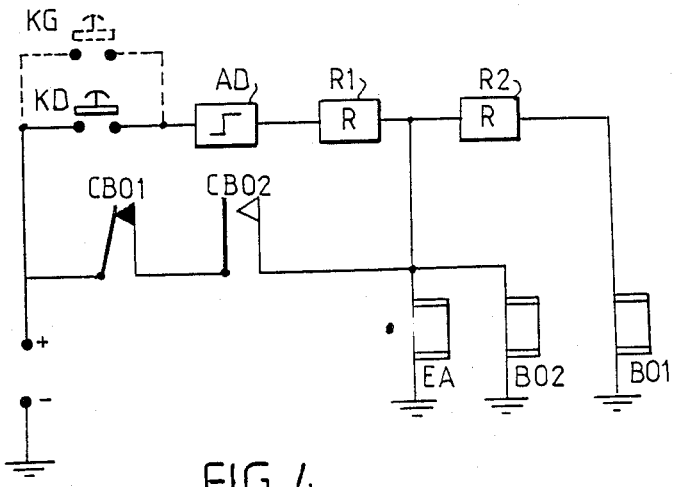
FIG.4

54
W
56
48
45
53
55
49
12
T
F
t
11
50
48
46
47
45
K
49
P
A
N
G
41
43
40
24
23
42
25
51
52
EA
R

DEVICE FOR INTERMITTENT APPLICATION OF PARTICLES OF A POWDERED DEVELOPER TO THE RECORDING SURFACE OF A MAGNETOGRAPHIC PRINTER

FIELD OF THE INVENTION

The present invention relates to a device for intermittent application of particles of a powdered developer to the recording surface of a magnetographic printer.

BACKGROUND OF THE INVENTION

Magnetographic printing machines are known which in response to the reception of electrical signals from a control unit make it possible to form images, for instance images of characters, on a printing substrate, typically a sheet or strip of paper. In these printers, which are similar to those described and shown in U.S. Pat. Nos. 3,161,544 and 4,072,957, printing of the images is attained by first forming a latent magnetic image, based on the signals received, on the surface of a magnetic recording element. The recording element is coated with a film of magnetic material and is generally in the form of a rotating drum or an endless belt. The latent magnetic image is then developed, or in other words made visible, with the aid of a powdered developer comprising particles of thermoplastic resin enclosing magnetic particles and pigments, which is attracted only by the regions of the recording element on which the latent image has been recorded. The developer then forms an image in powder on the surface of the element, and this powder image is then transferred to the printing substrate.

In order to permit the formation of the latent magnetic image on the surface of the recording substrate, these machines are provided with a recording device known as a transducer, which includes one or more magnetic recording heads into proximity with which the recording element is displaced. Each of these heads generates a magnetic field, whenever it is excited for a brief moment by an electric current of suitable intensity, creating magnetized domains of small dimensions on the surface of the recording element. These domains are virtually punctiform and are generally known as magnetized points.

A set of these magnetized points comprises the latent magnetic image. The portion of the surface of the recording element that passes before each head is conventionally known as the data recording track. The recording element generally includes a plurality of tracks, which may be subjected to recording either individually, in the course of successive recording operations, or simultaneously in the course of a single operation.

Magnetographic printing machines have already been made in which the transducer includes as many magnetic heads as there are tracks on the recording element. The heads are disposed side by side and are aligned along a direction transverse to the direction of displacement of the recording element. Since in these machines each track is associated with each of the transducer heads, respectively, recording of a latent image on the recording element is accomplished in the course of a single displacement revolution of this element along its endless orbit. Accordingly, these machines are capable of functioning at a high printing speed, which may for example be as high as a hundred pages per minute. Nevertheless, for certain applications, such high speed is not always necessary, so that a less-powerful magnetographic printer, that is also less expensive, equipped with a transducer that includes a number of magnetic heads notably less than the number of tracks of the recording element, may be sufficient. Such a magnetographic printing machine is known from U.S. Pat. No. 4,072,957, where the transducer includes only a single magnetic head, which is mounted in such a way that it can be displaced along a magnetic recording drum in the direction parallel to the axis of rotation of the drum.

In this known machine, recording of a latent magnetic image is performed track by track. Recording of the data in a track located facing the head is performed in the course of one complete revolution of the drum. At the end of this revolution, the head has been displaced so that it is facing the following track and allows recording of this following track in its turn. Under these conditions, the recording of the latent image on the drum is performed in as many revolutions of the drum as there are tracks on the drum. The development of the latent image, that is, the depositing of particles of developer onto the drum, is not undertaken until the formation of the image on the drum is completed. This operation is performed by means of an applicator device of a known type, which in the machine described in the aforementioned U.S. Pat. No. 4,072,957 includes a magnetic cylinder mounted on a shaft parallel to the axis of rotation of the drum. This cylinder, placed in proximity with the surface of the drum, is disposed in such a way as to be in contact with the developer particles contained in a reservoir placed beneath the drum. Thus when the magnetic cylinder revolves, the developer particles, which are driven to rotate by this cylinder, are moved to the vicinity of the surface of the drum and upon being attracted by the magnetized points on the surface are deposited on the portions of the surface on which the latent image has been formed. The particles thus deposited then travel past a transfer roller, which is normally pressed against the surface of the drum, and are thus transferred to a sheet of paper that at that moment is engaged between the drum and the transfer roller.

In this applicator device, the magnetic cylinder is not driven to rotate continuously but rather only for one revolution of the drum, following the formation of a latent image on the drum. Thus, during the periods of formation of latent images when no sheet of paper is engaged between the drum and the transfer roller, developer particles are prevented from being deposited on the drum and so do not soil the transfer roller. This applicator device, which functions intermittently and makes it possible to apply developer particles to the drum without causing clouds of particles capable of causing pollution inside the machine; however, it is still not completely satisfactory, because the drum is located a very slight distance away from the magnetic cylinder, and when the particles travel past the cylinder, the magnetized points that have been formed on the drum are necessarily exposed to the action of the magnetic flux generated by the cylinder, with the risk that they will be greatly altered or even erased.

Certainly, this disadvantage could be overcome by using an applicator device described in French Patent No. 2.408.462, which includes both a reservoir disposed below the recording element and containing developer particles and also a transport element arranged to place these particles in the vicinity of the surface of the recording element. The applicator device also includes a fixed deflector, interposed between the surface and the transport element to gather the particles transported by the transport element and arranged so that with this surface it forms a substantially prismatic spout, in which the gathered particles accumulate. The accumulated particles finally come into contact with the surface and are entrained by it in the direction of the apex of the prism comprising the spout, and the particles driven beyond this apex remain applied only to the magnetized points formed on the surface.

This applicator device, which causes no alteration whatever of the magnetized points and generates no pollution whatever inside the machine, nevertheless has the disadvantage of not assuring good development of the latent images when the transport element with which it is provided is driven intermittently rather than continuously.

OBJECT AND SUMMARY OF THE INVENTION

The present invention overcomes these disadvantages and proposes a device, mounted in a magnetographic printer in which the recording of each latent image is accomplished in the course of a plurality of successive displacement revolutions of the recording element along its endless orbit, which makes it possible to apply developer particles intermittently to the surface of the recording element, without causing pollution or disturbing the latent images that have been formed on the recording element.

More precisely, the present invention relates to a device for intermittent application of particles of a powdered developer to the recording surface of a magnetographic printer, in which the surface is driven by displacement along a predetermined closed orbit that makes it possible for it to move via a transfer station, where the developer that has been deposited on the surface is transferred to a printing substrate. The applicator device includes a device designed to apply developer particles permanently to the recording surface, and is characterized in that the recording surface cooperates with a device for recording latent images, arranged to form a latent image on this surface in the course of a plurality of successive displacement revolutions of the surface. The applicator device further includes a particle eliminator device disposed along the orbit, downstream of the point of application of the particles to the surface by the applicator device, between this application point and the transfer station; the eliminator device is arranged to pull away the particles of developer located on the surface, except during the last of the successive displacement revolutions of the surface.

The invention will be better understood and further objects and advantages thereof will become more apparent from the ensuing detailed description of exemplary embodiments, taken in conjunction with the drawings.

BRIEF DESCRIPTION OF THE DRAWINGS

FIG. 1 shows a magnetographic printing machine equipped with a particle applicator device according to the invention;

FIG. 4 is a diagram of the control circuit used for controlling the positioning of the squeegee belonging to the applicator device in FIG. 3.

DESCRIPTION OF THE PREFERRED EMBODIMENTS

Figure 2:
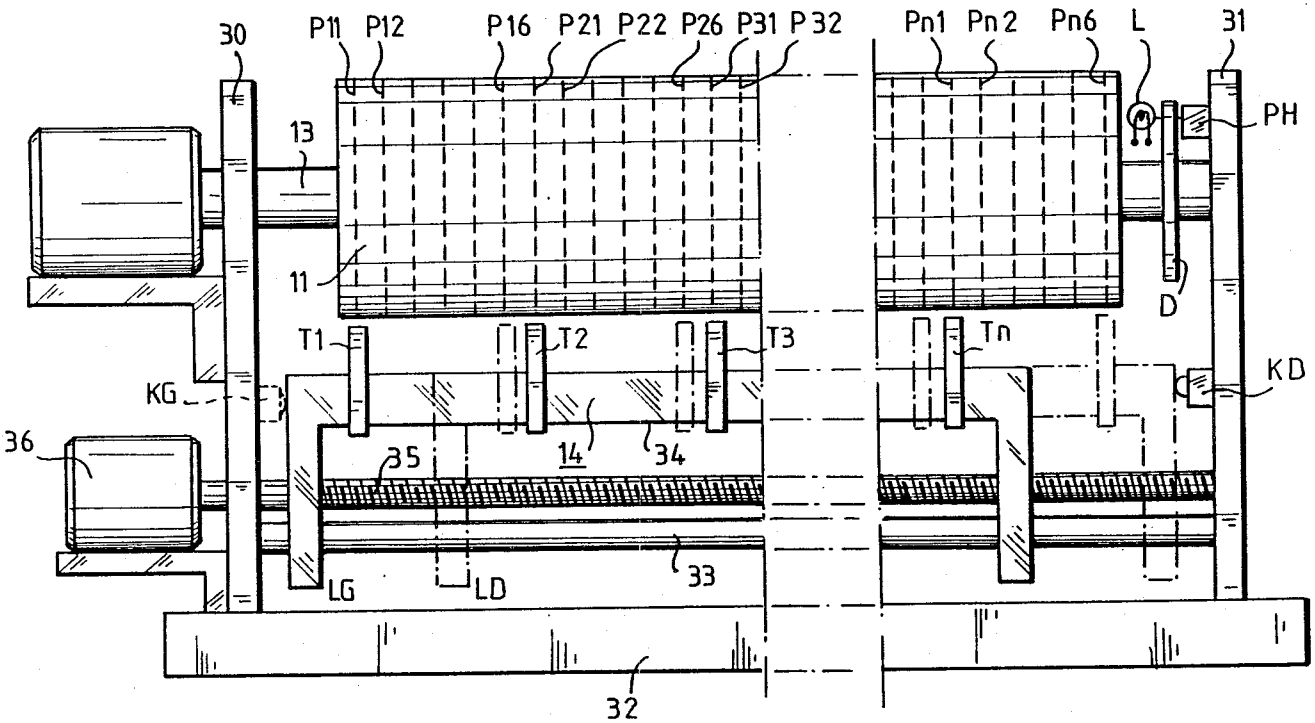
FIG. 2 is a view showing the structure of the recording device, and the control devices for actuating the particle applicator device with which the machine shown in FIG. 1 is equipped.

The printing machine schematic shown in FIG. 1 is a machine that prints sheets of paper that are drawn in succession and continuously from a supply magazine 10.

This machine includes a recording element, which in the example described comprises a drum 11 provided with a magnetic recording surface 12. The drum 11, which is mounted such that it can rotate about a horizontal axis 13, is driven to rotate in the direction indicated by the arrow F by an electric motor (not shown). The recording of information on the drum is accomplished by a recording device 14, the structure of which will be described hereinafter. It is assumed that this device includes a plurality of magnetic heads. Each of these heads, each time it is excited for a brief moment by an electric current, generates a variable magnetic field, the effect of which is to create virtually punctiform magnetized zones 15 on the cylindrical surface 12 of the drum that moves past the heads. A set of these zones comprises a latent magnetic image corresponding to an image to be printed. The magnetized zones then travel past an applicator device 16 disposed beneath the drum 11, which makes it possible to apply particles of a powdered developer, contained in a reservoir 17, to the cylindrical surface of the drum. The structure of this applicator device will also be described in detail hereinafter. In principle, the particles of developer that are thus applied to the drum by the device do not adhere anywhere except to the magnetized zones of the drum, and so they form an image in powder on the surface 12 of the drum. A retouching device 18 past which the image travels makes it possible to remove any developer particles that have adhere anywhere besides to the magnetized zones of the drum, as well as particles that are present in excessive quantity on these zones. It should be noted here that the developer thus deposited on the surface 12 of the drum comprises fine particles of thermoplastic resin containing magnetic particles and pigments; this resin is capable of melting when it is exposed to a heat source, which causes it to be affixed to a sheet of paper to which the developer has been transferred. After that, the developer particles that remain on the drum 11 after moving past the retouching device 18 are normally transferred in virtual totality to a sheet of paper 19, which after it has been removed from the magazine 10 is pressed by a transfer roller 20 against the surface of the drum 11. The region H where the roller 20 comes into contact with the surface of the drum whenever a sheet is not engaged between the roller nd the drum comprises the transfer station. It is at this station that the transfer of the powdered image that has been formed on the surface of the drum 11 to a sheet of paper engaged between the drum 11 and the roller 20 takes place. The developer particles that still remain on the surface of the drum once the transfer has been completed are then lifted by a cleaning device 21. The magnetized zones that have travelled past the cleaning device 21 then travel past an erasing device 22, which makes it possible for the portions of the drum 11 that have thus been demagnetized by this last device to be capable of re-magnetization when they once again travel past the recording device 14.

The structure of the recording device with which the machine shown in FIG. 1 is equipped is shown in FIG. 2. Turning now to FIG. 2, it can be seen that the shaft 13 about which the drum 11 rotates is supported at its ends by two vertical support plates 30 and 31 that are integrally joined to one another by means of a transverse connecting plate 32. The plates 30 and 31 also support a guide bar 33 disposed parallel to the shaft 13 of the drum 11. A carriage 34, mounted to slide on the bar 33, may be displaced in increments along a direction parallel to the shaft 13 of the drum by means of a threaded rod 35 that is integral with the drive shaft of an electric motor 36, which in turn is fixed to the vertical plate 30. Magnetic heads T1, T2, T3, . . . , Tn are disposed at regular intervals on the carriage 34, being placed in such a manner that they are located in the immediate proximity of the surface 12 of the drum !1.

When the motor 36 is excited, the magnetic heads, driven by the carriage 34, are simultaneously displaced in a direction parallel to the shaft 13 of the drum 11. The set comprising the carriage 34 and the magnetic heads T1, T2, T3, . . . , Tn can thus be displaced between two limit positions, one of which, LG, is shown in solid lines in FIG. 2 and the other, LD, is shown in dot-dash lines, also in FIG. 2. The portion of the surface of the drum 11 that travels past each of these heads when the carriage 34 is immobilized is conventionally known as a track. In FIG. 2, these tracks, which are circular, have been shown as dashed lines and identified by reference symbols such as P11, P12, . . . , P16, P21, . . . , P26, P31, . . . , Pn1, . . . , Pn6. For the sake of clarity in the drawing, the tracks have been shown in FIG. 2 in positions spaced relatively far apart from one another. However, it should be noted that in reality these tracks are quite close to one another; in the example described, the distance separating two adjoining tracks is on the order of 100 m. For recording information on the drum 11, these tracks are used in groups of 6 tracks, and each of the groups is associated respectively with each of the magnetic heads of the recording device 14. Thus the six tracks P11–P16 are intended to receive the information recorded by means of the head T1. Similarly, the six tracks P21–P26 are intended to receive the information recorded by means of the head T2, and so forth for the following groups of tracks. The heads T1, T2, T3, . . . , Tn are positioned on the carriage 34 in such a manner that when the carriage is immobilized in its limit position LG (on the left in FIG. 2), each of these heads is located facing the first track of the group with which it is associated. Thus in this position, the head T1 is located facing the track P11, the head T2 is located facing the track P21, and so forth, and the final head Tn faces the track Pn1. In the course of the same revolution of the drum 11, it is thus possible to record information simultaneously on tracks P11, P21, P31, . . . , Pn1. A clock disk D, affixed to the shaft 13 of the drum 11, is provided with an aperature, which upon each revolution of the drum allows a beam of light emitted by a light source L and sent toward a photoelectric cell PH to pass through for a brief instant. Each time this aperature allows the beam of light to pass through, or in other words each time the drum 11 has completed one revolution, the cell PH delivers an electrical signal to an electrical control circuit of a known type (not shown), which is arranged accordingly to control the instantaneous excitation of the motor 36, and consequently the very rapid displacement of the carriage 34 by one increment. The signal sent by this cell PH when the recording of the tracks P11, P21, P31, . . . , Pn1 is completed has the effect of moving the heads T1, T2, T3, . . . , Tn to face the tracks P12, P22, P32, . . . , Pn2, respectively. Thus in the course of a second revolution of the drum 11, information can be simultaneously recorded on tracks P12, P22, P32, . . . , Pn2. The electrical signal sent by the cell PH at the end of this second revolution causes the displacement of the carriage 34 once again by one increment, which moves the heads T1, T2, T3, . . . , Tn to face the tracks P13, P23, P33, . . . , Pn3; these tracks are those that in FIG. 2 are located immediately to the right of the tracks P12, P22, P32, . . . , Pn2. In the course of a third revolution of the drum, information can then be simultaneously recorded on tracks P13, P23, P33, . . . , Pn3.

The recording of information on the following tracks is accomplished in the same manner as described above; the carriage 34 is displaced by on increment in the direction of its limit position LD at the end of each of the rotations of the drum 11. It will accordingly be understood that with the recording device shown in FIG. 2, six complete cyles of rotation of the drum are required for recording a latent magnetic image on the drum. Naturally, in the course of the first five of these six revolutions, the erasing device 22 is invalidated, so that portions of the latent image that have already been recorded on the drum will not be erased. The erasing device is not reactivated until the powdered image corresponding to the latent image has been transferred to a sheet of paper. Beginning at the instant when the erasing device 22 has been reactivated, a new latent image can be recorded on the drum 11; this recording is effected either by displacing the carriage 3 incrementally beginning at its limit position LD in the direction of its limit position LG, or by first putting the carriage into its limit position LG and then displacing it incrementally in the direction of its limit position LD.

Figures 3, 3A:
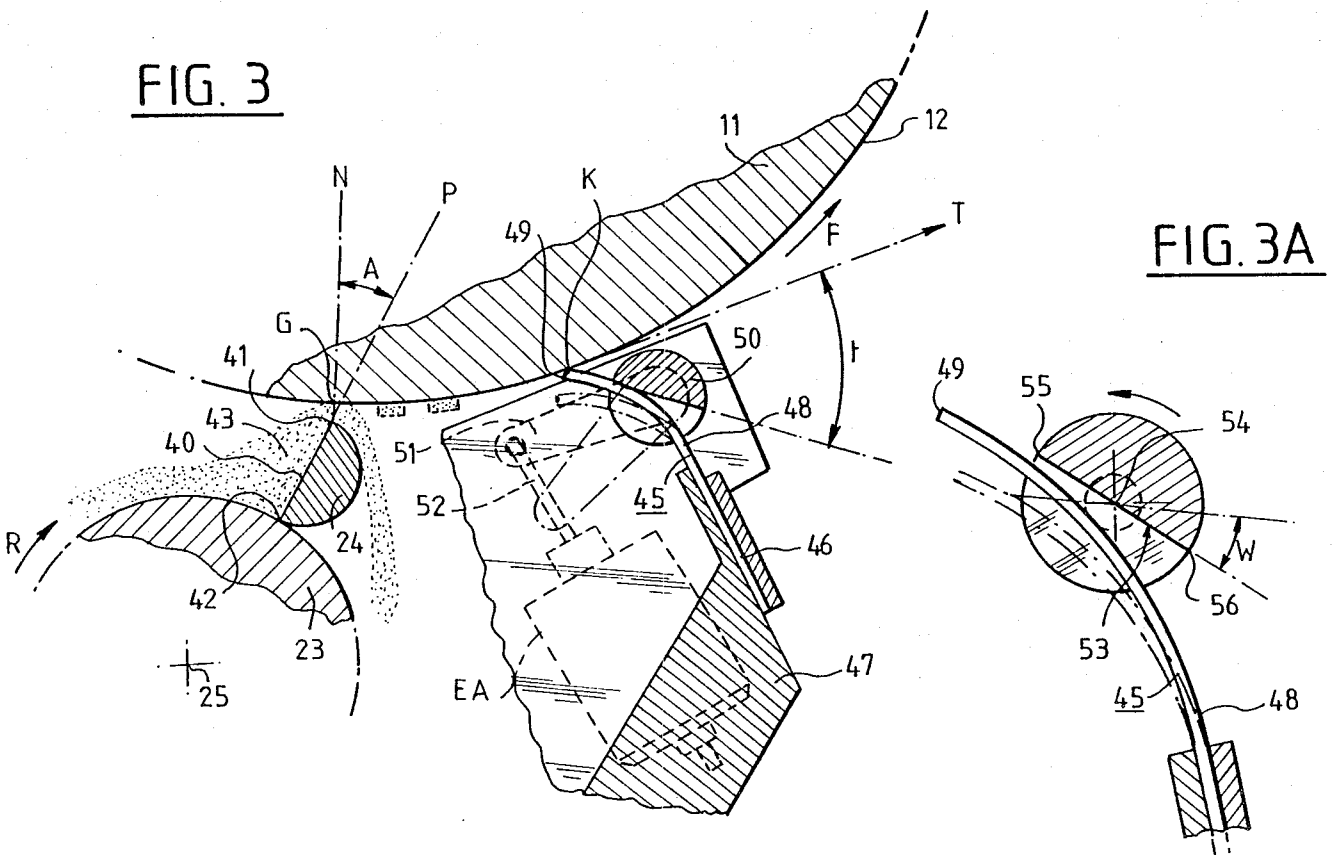
FIG. 3 is a sectional view showing in detail the embodiment of part of the applicator device of the machine shown in FIG. 1.
FIG. 3A is a view on a large scale intended to show the profile of the actuation shaft of the squeegee that is part of the applicator device shown in FIG. 3.

Referring to FIGS. 1 and 3, the structure of the device for applying particles that permits forming the powdered image corresponding to the latent image recorded on the drum in the course of six successive revolutions of the drum will now be described. As can be seen in FIG. 1, the applicator device includes on the one hand a transport element 23 that picks up developer particles in the reservoir 17 so as to place them in the vicinity of the surface 12 of the drum, and on the other hand includes a fixed deflector 24 disposed between the transport element 23 and the drum 11 for gathering the particles transported by the element 23 and applying them to the surface of the drum.

In the example described, the transport element 23 comprises a magnetic cylinder the axis of rotation 25 of which is parallel to the shaft 13 of the drum 11 and can rotate in two bearings (not shown), with which the side faces 26 and 27 of the reservoir 17 are respectively provided.

The deflector 24, which is shown on a large scale in FIG. 3, is a part made of a nonmagnetic material and fixed to the two side faces of the reservoir 17. This part has one plane face 40 limited by a first and second edge 41 and 42, which are parallel to the axes 13 and 25. The deflector 24 is disposed such that on the one hand, its first edge 41 is located in the immediate proximity of the surface 12 of the drum and on the other hand, if the generatrix of the drum where the plane P of the face 40 intersects the surface 12 of the drum is designated as G, this plane P forms an angle A with the plane normal to G at the surface of the drum, the size of the angle being less than 45°. The distance by which this generatrix G is separated from the first edge 41 of the deflector is always very small. In the example described, this distance is substantially equal to 1 mm. In the example described, the width of the face 40 is on the order of 1 cm.

The transport element 23 has a direction of rotation, indicated by the arrow R, such that it drives the developer particles toward the face 40 of the deflector. The second edge 42 of the deflector is located virtually in contact with the surface of the transport element, such that the particles that are driven by this transport element are for the most part prevented from moving onward by the deflector 24, so that they accumulate in a spout 43 of substantially prismatic shape defined by the cylindrical surface 12 of the drum and the face 40 of the deflector 24. The direction of rotation F of the drum 11 is such that, when the quantity of particles accumulated in the spout 43 is sufficient to reach the first edge 41 of the deflector, the particles in proximity with the surface 12 of the drum are driven in the direction of the generatrix G, which arbitrarily comprises the apex of the spout 43. Some of the particles are then applied to the magnetized zones 15 of the drum. The particles thus driven by the drum are not prevented from moving onward by the deflector 24, because the deflector does not touch the surface of the drum, so that it consequently leaves a narrow opening between its first edge 41 and the drum, the width of the opening nevertheless being sufficient to permit developer particles driven by the drum to exit from the spout 43. The developer particles applied to the magnetized zones of the drum and exiting from the spout 43 continue to adhere to these zones and thus make the image that is to be printed visible, while the particles that emerge from the spout 43 without being retained on the drum drop back into the reservoir 17 Since the distance separating the edge 41 of the deflector and the surface 12 of the drum is quite short, the number of particles that also emerge from the spout 43 is relatively low, such that the particles which are not retained by the drum and hence drop back into the reservoir 17 are not very numerous and so do not form clouds of particles capable of polluting the machine.

According to the invention, the applicator device 16 also includes a squeegee 45, as shown in FIG. 1, which is placed between the deflector 24 and the transfer station H and is actuated by an electromagnet EA in such a manner as to be put into either a first position, in which it is in contact with the surface 12 of the drum and hence stops the travel of the developer particles which, emerging from the spout 43, remain pressed against this surface, or a second position, in which it is spaced apart from the surface and thus allows the particles that have been deposited on it to move on as the drum rotates.

The particles which are stopped by the squeegee 45 when it is in its first position finally drop back into the reservoir 17. However, to prevent some of the particles from sliding between the squeegee and the drum and thus continuing to adhere to the surface of the drum, the squeegee must be pressed against this surface with a sufficient force, the value of which also depends on the size of the particles and on the force that holds the particles on the surface of the drum.

In an advantageous embodiment which is shown in FIG. 3, the squeegee is in the form of a flexible blade including on the one hand a fixed portion 46, intended to permit the blade to be attached firmly to a fixed transverse plate 47 that is part of the reservoir 17, and on the other hand a free portion 48 terminated by an edge 49 that is parallel to the axes 13 and 25 and is pressed against the surface 12 of the drum; this edge thus comes to contact the surface along a generatrix K of the drum. The flexible blade 45 is positioned such that its terminal portion, which is near the edge 49, forms an angle t, the value of which is between 10° and 45°, with the half-tangent T to this surface 12 at the point of contact K and oriented in the direction of displacement of the drum.

To assure that practically none of the particles that have been stopped by the blade will slide between the blade and the surface of the drum, the blade must be pressed against the surface with a sufficient force. For the type of particles used in the example described, it has been found that the force P exerted per unit of length on the edge 49 of the blade in contact with the drum must be equal to at least 2.5 N/dm. If b* is the length, a the width and e the thickness of the free portion 48 of the blade (this length b corresponding to the length of the edge 49 of the blade), then it is known that when the blade is subjected to a flexion such that the edge 49 of the blade is displaced by a distance f with respect to its original position, the force P that is exerted per unit of length on the edge 49 can be expressed as follows:

$$P = \frac{Ee^3 f}{4a^3}$$

E is the value of the modulus of elasticity of the material comprising the blade. It can thus be seen that if a material having sufficient elastic properties is selected for the blade, the values for the width a, the thickness e and the flexion f that must be adopted to obtain a force P the value of which is equal to at least 2.5 N/dm can be determined.

In practice, it is arranged that the amplitude of the flexion f undergone by the flexible blade is equal to at least one-half the width a of the blade; this arrangement permits the flexible blade, if it is made of one of the materials conventionally selected for elastic blades, to remain within the range of elastic deformation. However, the hardness of the material used to make the flexible blade must not be very great, so as not to risk deterioration of the surface of the drum against which the blade is pressed. It has been found that in order for the flexible blade to remain within the limit of elastic deformation and not to cause any degradation of the surface of the drum, the material used to make the blade must have a modulus of elasticity E at least equal to 300 daN/mm$^2$ and a hardness equal to no more than 600 Vickers. The flexible blade may for example be a blade of polyethylene terephthalate, conventionally known as Mylar (registered trademark), which has a modulus of elasticity equal to virtually 480 daN/mm$^2$; the free portion of this blade has a width a practically equal to 8 mm, and a thickness e practically equal to 0.2 mm. The force P exerted per unit of length on the edge 49 of the blade, when the blade undergoes a flexion f equal to one-half the width a of the blade or in this case 4 mm, accordingly has the following value:

$$P = \frac{480 \times (0.2)^3 \times 4}{4 \times (8)^3} = 7.5 \times 10^{-3}\ daN/mm = 7.5\ N/dm$$

The flexible blade can also be a blade of stainless steel having a modulus of elasticity equal to virtually 25,000 daN/mm$^2$, the free portion of this blade having a width a practically equal to 8 mm and a thickness e practically equal to 0.05 mm. The force P exerted per unit of length on the edge 49 of the blade, when the blade undergoes a flexion f equal to one-half the width a of the blade or in this case 4 mm, accordingly has the following value:

$$P = \frac{25{,}000 \times (0.05)^3 \times 4}{4 \times (8)^3} = 6.1 \times 10^{-3}\ daN/mm = 6.1\ N/dm$$

In order that the flexible blade will not undergo excessively rapid wear because of its friction on the surface of the drum, the force with which the blade is pressed against the surface must not be excessively high. Experiments have shown that to obtain moderate wear of the blade, the force P exerted per unit of length on the edge 49 of the blade must not in practice exceed the value of 20 N/dm.

As can be seen in FIG. 3, the applicator device 16 also includes an actuating device making it possible to move the squeegee 45 away from the surface 12 of the drum and thus to allow the particles that have been applied to remain on this surface, with the aid of the deflector 24.

This actuation device is embodied by a rod 50 disposed parallel to the axes 13 and 25 and capable of pivoting in two bearings (not shown) fixed to the side faces 26 and 27 of the reservoir 17, and a lever 51 mounted on one of the ends of the rod 50, the arm of the lever being pivoted at the end of a sliding rod 52 integral with the movable armature of an electromagnet EA, which in turm is fixed to one of the side faces of the reservoir 17. When the electromagnet EA is not excited, the lever 51 occupies a first position, its position of repose, which is shown in dashed lines in FIG. 3. On the other hand, when the electromagnet EA is excited, the lever 51 occupies a second position or working position shown in dot-dash lines in FIG. 3. In the exemplary embodiment shown in FIG. 3, in which the squeegee 45 comprises a flexible blade, the rod 50 is machined in such a way that in its middle portion, over a length equal at least to the length of the blade, it has a plane face 53, which as seen in FIG. 3A passes through the axis 54 of the rod and is limited by two edges 55 and 56. This rod 50 is positioned such that its middle portion, which is accordingly of semi-cylindrical shape, is located between the free portion 48 of the blade 45 and the surface 12 of the drum, and such that when the lever 51 is in its position of repose, the edge 55 of this middle portion is located as close as possible to this free portion 48, without contacting it, as can be seen in FIG. 3A. Under these conditions, this middle portion of the rod 50, when the lever 51 is in the position of repose, does not threaten to change the value of the force with which the edge 49 of the blade 45 is pressed against the surface of the drum.

If the electromagnet EA is now excited, the lever 51 assumes its working position and pivots the rod 50 by an angle w in the direction indicated by the arrow in FIG. 3A.

In this case, the middle portion of the rod occupies a position that as shown in dot-dash lines in FIG. 3A forms an angle w with the original position, and the edge 55 of this middle portion, now pressed against the free portion 48 of the blade 45, causes this free portion to deflect to an increasing extent and thus move away from the surface 12 of the drum.

Turning now to FIG. 4, the control circuit for exciting the electromagnet EA will now be described. This circuit includes manual control contacts and relay contacts provided for use under the conditions that will now be described. In FIG. 4, each relay contact is identified by the same reference numeral as that of the coil it controls, but is preceded by the letter C. A contact, normally closed when the relay coil that it controls is not excited, is represented in this drawing figure by a black triangle. The relays shown in this drawing figure are normally supplied with direct current between two terminals + and −; the negative terminal (−) is connected to ground.

In order to describe the function of the circuit shown in FIG. 4, it is assumed that each of the heads of the recording device has completed recording information on the first five of the six tracks with which it is associated, and this recording has been performed in the course of five successive revolutions of the drum 11. In the course of the fifth revolution the magnetic heads T1, T2, T3, . . . , Tn have been placed facing the tracks P15, P25, P35, . . . , Pn5, respectively, so that the electrical signal that at the end of the fifth revolution appears at the output of the cell PH causes the displacement of the carriage 34 by one increment toward the right. The effect of this displacement is first to move the heads T1, T2, T3, . . . , Tn to face the tracks P16, P26, P36, . . . , Pn6, respectively and thus to allow these tracks to be recorded in the course of a sixth revolution of the drum 11, and on the other hand depresses a contact KD, which as shown in FIG. 2 is disposed so as to be actuated by the carriage 34 when the carriage is put in its limit position LD. As will be understood with reference to FIG. 4, depression of the contact KD causes a positive voltage to be applied to the input of a drifter amplifier AD; this input is in effect connected to the positive terminal via the contact KD.

The drifter amplifier is designed to furnish a single positive pulse to its output each time its input is connected to a positive potential. The pulse that appears at the output of this drifter amplifier AD is applied to the input of a time-lag element R1, which in response to receiving this pulse furnishes a delayed pulse to its output. The time lag of this element R1 is arranged such that this delayed pulse appears at the output of this element only when the portions of the drum surface that move past the heads T1, T2, T3, . . . , Tn at the instant when these heads have been moved to face the tracks P16, P26, P36, . . . , Pn6 are at the point of passing beneath the blade 45. The delayed pulse that then appears at the output of the element R1 is applied first to the input of a second time-lag element R2 and second to the electromagnet EA and to a relay B02

The relay B02, when excited, then closes its contact CB02 and completes a holding circuit for itself and for the electromagnet EA, via a normally closed contact CB01 and the contact CB02. The electromagnet EA when excited actuates the rod 52, thus moving the lever 51 to the working position, with the effect of moving the blade 45 away from the surface 12 of the drum. Under these conditions, this blade, which until now has pulled away the developer particles that on emerging from the spout 43 remained applied to the surface of the drum, now allows these particles to remain on the surface, such that the particles can reach the transfer station H, where they are then transferred to a sheet of paper 19 that at that moment is engaged between the drum 11 and the transfer roller 20. The time lag of the element R2 is arranged such that in response to an electrical pulse applied to its input, this element furnishes a delayed pulse at its output at the end of a time substantially equal to the time that the drum takes to accomplish one revolution. More precisely, this delayed pulse appears at the output of R2 at the moment when the powder image corresponding to the latent image formed in the course of six successive revolutions of the drum has completely passed before the blade 45. This delayed pulse is applied to a relay B01, which upon being excited for a short moment instantaneously opens its contact CB01. The opening of the contact CB01 has the effect of de-exciting the B02 and the electromagnet EA. Consequently, the de-excited relay B02 opens its holding contact CB02, while the electromagnet EA ceases to hold the blade 45 spaced apart from the surface of the drum.

Beginning at that instant, the developer particles that after emerging from the spout 43 remain applied to the surface of the drum are prevented from passing on by the blade 45 and then drop back into the reservoir 17.

The printing machine shown in FIG. 1 may be designed such that recording of a latent image on the drum takes place only when the carriage 34 is displaced incrementally from its limit position LG in the direction of its limit position LD. In this case, when the carriage 34 has arrived at its limit position LD at the end of its incremental displacement, then as soon as the recording of information on tracks P16, P26, P36, . . . , Pn6 has been completed, the carriage is rapidly returned to its limit position LG, to permit recording of a new latent image on the drum; the excitation of the heads of the recording device 14 is interrupted for the entire duration of the return motion of the carriage.

The machine shown in FIG. 1 may also be designed such that recording of a latent image on the drum takes place when the carriage 34 is displaced incrementally from either its limit position LG or its limit position LD. In this case, when the carriage 34 has arrived at its limit position LD at the end of its incremental displacement, then as soon as recording of the information on tracks P16, P26, . . . , Pn6 has been completed, the carriage is moved incrementally to its limit position LG, while a new latent image is formed on the drum. During the first five of the six revolutions of the drum required for forming this new image, the electromagnet EA is not excited, so that none of the developer particles that emerge from the spout 43 can arrive at the transfer station H. Once the carriage 34 reaches its limit position LG in the consequence of its incremental displacement and thus places the heads facing tracks P11, P21, . . . , Pn1, the electromagnet EA is excited, at the instant when the portions of the surface of the drum that pass beneath these heads at the instant when the carriage arrives at its position LG are on the point of passing beneath the blade 45. The excitation of the electromagnet at this instant can be advantageously triggered by a contact KG, which as shown in FIG. 2 is disposed in such a manner as to be actuated by the carriage 34 at the moment the carriage reaches its limit position LG; the contact KG is mounted such that it bypasses the terminals of the contact KD, as shown in FIG. 4.

Definitively, regardless of the mode adopted for forming the latent images on the drum, provided that the formation of each of the images is performed in the course of a plurality of successive revolutions of the drum (that is, at least two revolutions), it is understood that the formation of the powdered image corresponding to the latent image is undertaken only in the course of the last of these revolutions; the powdered image is transferred immediately after that to a sheet of paper. Under these conditions, the transfer roller 20 is not threatened with being spotted by developer particles during the periods when no sheet of paper is engaged between the roller and the drum 11.

What is claimed is:

1. An applicator device for intermittent application of particles of a powdered developer to the recording surface (12) of a magnetographic printer, the surface being driven by displacement along a predetermined closed orbit that allows it to travel past a transfer station (H) where the developer that has been deposited on the surface is transferred to a printing substrate (19), means (17, 23, 24) for permanent application of 8 developer particles to said recording surface (12), means for recording latent images (14) on the recording surface in the course of a plurality of successive displacement revolutions of the surface, and a particle eliminator device (45, 50, 51, 52, EA) disposed along said orbit, downstream of the application point (G) of particles on the recording surface by said applicator device, said particle eliminator device disposed between the application point (G) and said transfer station (H) being arranged to pull away particles of developer located on this surface except during the final one of said successive displacement revolutions of the surface.

2. An applicator device as defined by claim 1, characterized in that the particle eliminator device includes a squeegee (45) disposed between the application point (G) of the particles and the transfer station (H) and normally urged to press against the recording surface (12) to pull away the particles located thereon, and means (50, 51, 52, EA) for actuating the squeegee, said actuating means being arranged to move the squeegee away from the surface solely during the final one of said successive displacement revolutions of the surface.

3. An applicator device as defined by claim 2, characterized in that the squeegee (45) comprises a flexible blade, one edge (49) of which is pressed against the recording surface (12), the blade forming an angle (t), the value of which is between 10° and 45°, with the half-tangent (T) to said surface passing through the point of contact (K) of the blade with said surface and oriented in the direction of displacement (F) of said surface.

4. An applicator device as defined by claim 2, characterized in that the squeegee (45) comprises a flexible blade, one edge (49) of which is pressed againt the recording surface (12) with a force per unit of length of said edge that is at least equal to 2.5 N/dm.

5. An applicator device as defined by claim 3, characterized in that the squeegee (45) comprises a flexible blade, one edge (49) of which is pressed againt the recording surface (12) with a force per unit of length of said edge that is at least equal to 2.5 N/dm.

6. An applicator device as defined by claim 3, characterized in that the flexible blade (45) is made of a material having a modulus of elasticity at least equal to 300 daN/mm$^2$ and a hardness at least equal to 600 Vickers.

7. An applicator device as defined by claim 4, characterized in that the flexible blade (45) is made of a material having a modulus of elasticity at least equal to 300 daN/mm$^2$ and a hardness at least equal to 600 Vickers.

8. An applicator device as defined by claim 5, characterized in that the flexible blade (45) is made of a material having a modulus of elasticity at least equal to 300 daN/mm$^2$ and a hardness at least equal to 600 Vickers.

9. An applicator device as defined by claim 2, characterized in that the means (50, 51, 52, EA) for actuating the squeegee includes an element (50) pivoted about an axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

10. An applicator device as defined by claim 3, characterized in that the means (50, 51, 52, EA) for actuating the squeegee includes an element (50) pivoted about an axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

11. An applicator device as defined by claim 4, characterized in that the means (50, 51, 52, EA) for actuating the squeegee includes an element (50) pivoted about an axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

12. An applicator device as defined by claim 5, characterized in that the means (50, 51, 52, EA) for actuating the squeegee includes an element (50) pivoted about an axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

13. An applicator device as defined by claim 6, characterized in that the means (50, 51, 52, EA) for actuating the squeegee includes an element (50) pivoted about an axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

14. An applicator device as defined by claim 7, characterized in that the means (50, 51, 52, EA) for actuating the squeegee includes an element (50) pivoted about an axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

15. An applicator device as defined by claim 8, characterized in that the means (50, 51, 52, EA) for actuating the squeegee includes an element (50) pivoted about a axis (54) and arranged to occupy one or the other of two positions, said element being provided with a support edge (55) arranged such that when said element is placed in its first position, this support edge is located in the immediate proximity of the squeegee, while when said element is in its second position, this support edge pushes the squeegee and urges it to remain spaced apart from the recording surface.

16. An applicator device as defined by clam 9, characterized in that the device (50, 51, 52, EA) for actuating the squeegee further includes an electromagnet (EA) the movable armature of which is coupled to the articulated element (50) for actuating this element and permits it to be placed in one or the other of its two positions.

17. An applicator device as defined by claim 9, characterized in that the articulated element (50) comprises a rod having a semi-cylindrical portion limited by two edges (55 and 56), one of which comprises the support edge (55).

18. An applicator device as defined by claim 10, characterized in that the articulated element (50) comprises a rod having a semi-cylindrical portion limited by two edges (55 and 56), one of which comprises the support edge (55).

19. An applicator device as defined by claim 11, characterized in that the articulated element (50) comprises a rod having a semi-cylindrical portion limited by two edges (55 and 56), one of which comprises the support edge (55).

20. An applicator device as defined by claim 12, characterized in that the articulated element (50) comprises a rod having a semi-cylindrical portion limited by two edges (55 and 56), one of which comprises the support edge (55).

21. An applicator device as defined by claim 13, characterized in that the articulated element (50) comprises a rod having a semi-cylindrical portion limited by two edges (55 and 56), one of which comprises the support edge (55).

22. An applicator device as defined by claim 14, characterized in that the articulated element (50) comprises a rod having a semi-cylindrical portion limited by two edges (55 and 56), one of which comprises the support edge (55).

23. An applicator device as defined by claim 15, characterized in that the articulated element (50) comprises a rod having a semi-cylindrical portion limited by two edges (55 and 56), one of which comprises the support edge (55).

24. An applicator device as defined by claim 16, characterized in that the articulated element (50) comprises a rod having a semi-cylindrical portion limited by two edges (55 and 56), one of which comprises the support edge (55).

25. An applicator device as defined by claim 1, characterized in that the means (17, 23, 24) that permanently applies the developer particles to the recording surface (12) includes the following:

a reservoir (17) disposed beneath said surface (12) and containing developer particles;

a transport element (23) disposed to put these particles in the vicinity of this surface;

and a fixed deflector (24) disposed between this surface (12) and this transport element (23) for gathering the particles transported by the latter, this deflector being disposed such as to form a spout (43) of substantially prismatic shape with said recording surface, in which spout the particles thus gathered accumulate, the particles finally coming into contact with said surface and being driven toward the apex (G) of the prism, the particles driven beyond said apex not remaining applied anywhere except to the magnetized portions of said surface (12).

26. An applicator device as defined by claim 2, characterized in that the means (17, 23, 24) that permanently applies the developer particles to the recording surface (12) includes the following:

a reservoir (17) disposed beneath said surface (12) and containing developer particles;

a transport element (23) disposed to put these particles in the vicinity of this surface;

and a fixed deflector (24) disposed between this surface (12) and this transport element (23) for gathering the particles transported by the latter, this deflector being disposed such as to form a spout (43) of substantially prismatic shape with said recording surface, in which spout the particles thus gathered accumulate, the particles finally coming into contact with said surface and being driven toward the apex (G) of the prism, the particles driven beyond said apex not remaining applied anywhere except to the magnetized portions of said surface (12).

27. An applicator device as defined by claim 3, characterized in that the means (17, 23, 24) that permanently applies the developer particles to the recording surface (12) includes the following:

a reservoir (17) disposed beneath said surface (12) and containing developer particles;

a transport element (23) disposed to put these particles in the vicinity of this surface;

and a fixed deflector (24) disposed between this surface (12) and this transport element (23) for gathering the particles transported by the latter, this deflector being disposed such as to form a spout (43) of substantially prismatic shape with said recording surface, in which spout the particles thus gathered accumulate, the particles finally coming into contact with said surface and being driven toward the apex (G) of the prism, the particles driven beyond said apex not remaining applied anywhere except to the magnetized portions of said surface (12).

* * * * *

UNITED STATES PATENT AND TRADEMARK OFFICE

CERTIFICATE OF CORRECTION

PATENT NO. : 4,877,341

DATED : October 31, 1989

INVENTOR(S) : CHERBUY et al

It is certified that error appears in the above-identified patent and that said Letters Patent is hereby corrected as shown below:

In Col. 12, (claim 1), line 25, the number "8" should be deleted.

Signed and Sealed this

First Day of January, 1991

*Attest:*

HARRY F. MANBECK, JR.

*Attesting Officer*

*Commissioner of Patents and Trademarks*